US009147376B2

(12) United States Patent
Lee

(10) Patent No.: US 9,147,376 B2
(45) Date of Patent: Sep. 29, 2015

(54) DISPLAY DEVICE AND METHOD

(75) Inventor: Yong Jae Lee, Yongin-si (KR)

(73) Assignee: ANAPASS INC., Seoul (KR)

( * ) Notice: Subject to any disclaimer, the term of this patent is extended or adjusted under 35 U.S.C. 154(b) by 506 days.

(21) Appl. No.: 13/149,388

(22) Filed: May 31, 2011

(65) Prior Publication Data

US 2011/0292020 A1 Dec. 1, 2011

(30) Foreign Application Priority Data

May 31, 2010 (KR) ..... 10-2010-0050930

(51) Int. Cl.

*G09G 5/00* (2006.01)
*G09G 3/36* (2006.01)
*G09G 3/20* (2006.01)

(52) U.S. Cl.

CPC ..... *G09G 5/008* (2013.01); *G09G 3/3688* (2013.01); *G09G 3/20* (2013.01); *G09G 2310/027* (2013.01); *G09G 2310/08* (2013.01); *G09G 2320/0223* (2013.01); *G09G 2370/08* (2013.01)

(58) Field of Classification Search

USPC ..... 345/211, 204, 212, 213, 99, 98
See application file for complete search history.

(56) References Cited

U.S. PATENT DOCUMENTS

2008/0062072 A1* 3/2008 Yang et al. ..... 345/55
2009/0015537 A1* 1/2009 Park et al. ..... 345/99
2009/0167750 A1* 7/2009 Hong et al. ..... 345/213
2009/0325521 A1* 12/2009 Dubash et al. ..... 455/150.1
2010/0259564 A1* 10/2010 Ahn et al. ..... 345/690

FOREIGN PATENT DOCUMENTS

KR 10-2006-0117715 A 11/2006
KR 10-2009-0075044 A 7/2009
KR 10-2009-0096999 A 9/2009
KR 10-2010-0038825 A 4/2010

OTHER PUBLICATIONS

"Modeling, Design and Characterization of a New Low-Jitter Analog Dual Tuning LC-VCO PLL Architecture," Nonis, Roberto, IEEE Journal of Solid-State Circuits, vol. 40, No. 6, Jun. 2005, pp. 1303-1309.*

* cited by examiner

*Primary Examiner* — William Boddie
*Assistant Examiner* — Jeffrey A Parker
(74) *Attorney, Agent, or Firm* — Oliff PLC

(57) ABSTRACT

A display device and method are provided. The display device includes a timing controller configured to insert a clock between data and transmit the data in which the clock has been inserted, transmission lines configured to transfer the data in which the clock has been inserted, and data driver integrated circuits (ICs) configured to receive the data in which the clock has been inserted, separate the clock from the data, and drive data lines of a liquid crystal panel on the basis of the clock and the data. The timing controller includes a phase-locked loop (PLL) including an oscillator and an inductor-capacitor (LC) resonant circuit, and a reset signal generator configured to generate a reset signal causing the PLL to start coarse frequency tuning when initial power is applied or a frequency of an applied input clock changes.

15 Claims, 4 Drawing Sheets

DISPLAY DEVICE AND METHOD

TECHNICAL FIELD

The described technology relates generally to a display device and method and, more particularly, to an interface system between a timing controller and data driver integrated circuits (ICs) of a display device.

BACKGROUND

Lately, a low-voltage differential signaling (LVDS) interface is frequently being used for data transmission between a timing controller and data driver ICs of a display device. The LVDS interface is a parallel interface, and a plurality of data diver ICs are connected with a pair of LVDS interfaces. However, a data driver IC having a capacitance load component is connected to one signal line, which causes an impedance mismatch and limits a slew rate. Consequently, a problem occurs in high-speed operation. To solve this problem, a point-to-point interface is used, and a phase-locked loop (PLL) or delay-locked loop (DLL) is used for clock and data recovery. Here, the PLL and DLL use delay-cell-based circuits. Thus, the PLL and DLL are sensitive to temperature and process variation and vulnerable to supply noise, thus having a poor jitter characteristic. Consequently, a PLL having a low-jitter characteristic is necessary to transfer data between a timing controller and data driver ICs at high speed.

SUMMARY

Embodiments of the present disclosure provide an interface system between a timing controller and data driver integrated circuits (ICs) in a display device.

In one embodiment, a display device is provided. The display device includes: a timing controller configured to insert a clock between data, and transmit the data in which the clock has been inserted; transmission lines configured to transfer the data in which the clock has been inserted; and data driver ICs configured to receive the data in which the clock has been inserted, separate the clock from the data, and drive data lines of a liquid crystal panel on the basis of the clock and the data. Here, the timing controller includes: a phase-locked loop (PLL) including an oscillator and an inductor-capacitor (LC) resonant circuit; and a reset signal generator configured to detect unlock of the PLL and generate a reset signal causing the PLL to perform coarse frequency tuning.

In another embodiment, a display method is provided. The display method includes: inserting, at a timing controller, a clock between data and transmitting the data in which the clock has been inserted through transmission lines; receiving, at data driver ICs, the data in which the clock has been inserted, separating the clock from the data, and driving data lines of a liquid crystal panel on the basis of the clock and the data. Here, when initial power is applied, a frequency of an input clock applied to the timing controller changes, or a PLL included in the timing controller is unlocked, the PLL performs coarse frequency tuning to lock the clock to be inserted between the data.

The Summary is provided to introduce a selection of concepts in a simplified form that are further described below in the Detailed Description. The Summary is not intended to identify key features or essential features of the claimed subject matter, nor is it intended to be used as an aid in determining the scope of the claimed subject matter.

BRIEF DESCRIPTION OF THE DRAWINGS

The above and other features and advantages of the present disclosure will become more apparent to those of ordinary skill in the art by describing in detail example embodiments thereof with reference to the attached drawings in which.

DETAILED DESCRIPTION

Figure 1:
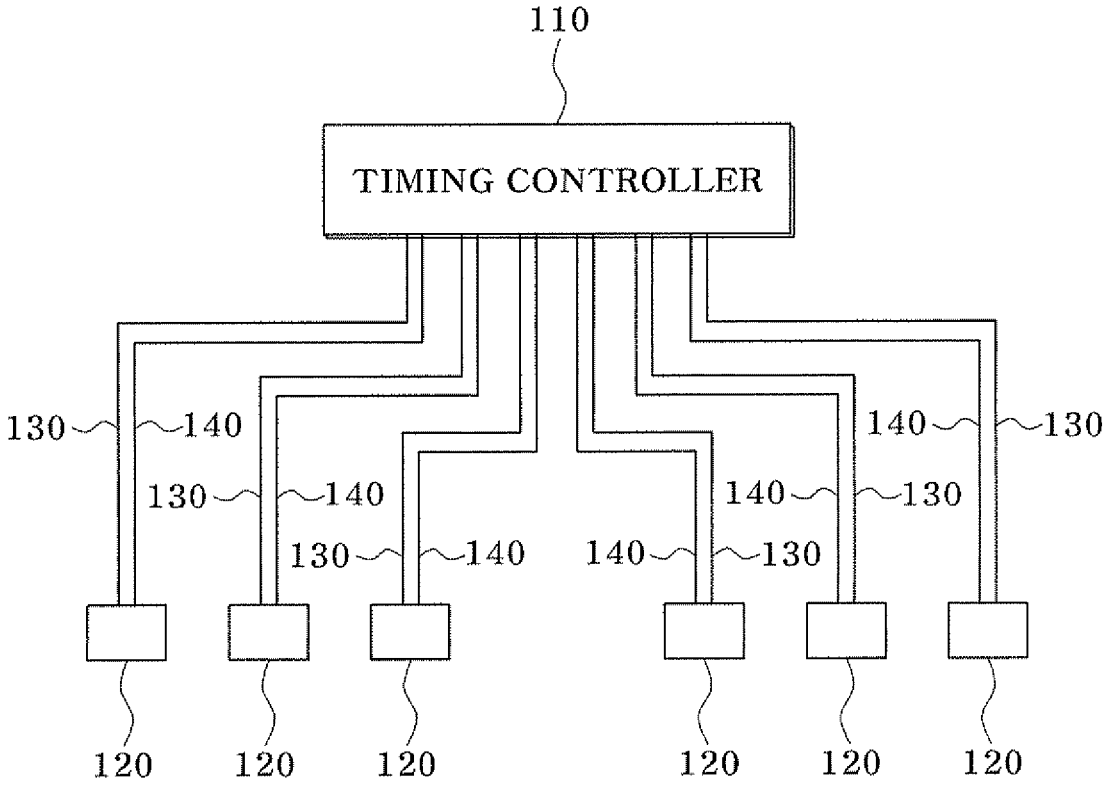
FIG. 1 illustrates an interface between a timing controller and respective data driver integrated circuits (ICs) of a display device according to an embodiment of the present disclosure.

It will be readily understood that the components of the present disclosure, as generally described and illustrated in the Figures herein, could be arranged and designed in a wide variety of different configurations. Thus, the following more detailed description of the embodiments of apparatus and methods in accordance with the present disclosure, as represented in the Figures, is not intended to limit the scope of the disclosure, as claimed, but is merely representative of certain examples of embodiments in accordance with the disclosure. The presently described embodiments will be best understood by reference to the drawings, wherein like parts are designated by like numerals throughout.

Meanwhile, terms used herein are to be understood as follows.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between," "adjacent" versus "directly adjacent," "on" versus "directly on," etc.).

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises," "comprising," "includes", and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 illustrates an interface between a timing controller and respective data driver integrated circuits (ICs) of a display device according to an embodiment of the present disclosure.

A timing controller 110 is connected with data driver ICs 120 through transmission lines 130, respectively. The timing controller 110 inserts a first clock between data, and transmits the data in which the first clock has been inserted to the data driver ICs 120 through the transmission lines 130, respectively. Thus, the timing controller 110 does not require an additional connection line to transmit the clock. The timing controller 110 may convert the data in which the clock has been inserted into a differential signal and serially transmit the differential signal. The timing controller 110 includes a phase-locked loop (PLL), and the PLL includes an inductor-capacitor (LC) voltage-controlled oscillator (VCO). When the PLL is unlocked, the timing controller 110 performs coarse tuning and fine tuning, thereby locking the PLL. For a predetermined initialization time after the PLL is locked, the timing controller 110 transmits a clock-shaped pattern to the respective data driver ICs. Here, the initialization time includes at least one of a predetermined time after the PLL is locked for the first time by application of power, a predetermined time after the PLL is unlocked due to an intermediate change in a frequency of an input clock input to the PLL and then locked again, or the last vertical blank period. During the initialization time, the respective data driver ICs 120 are enabled to smoothly recover the clock. The timing controller 110 transmits an initialization signal, which is kept in a high state during the initialization time, to the data driver ICs 120 through initialization signal lines 140, respectively.

The data driver ICs 120 separately receive the differential signal through the transmission lines 130 respectively, recover the data in which the clock has been inserted, and separate the first clock from the data in which the clock has been inserted. Each of the data driver ICs 120 generates a second clock having a frequency that is a multiple of a first clock frequency, samples and then latches the data using the second clock, and drives a data line of a liquid crystal panel using the latched data. While the initialization signal is received through the initialization signal lines 140, the data driver ICs 120 receive the clock-shaped pattern through the transmission lines 130, respectively. When a current state is an unlocked state while the clock-shaped pattern is received, each of the data driver ICs 120 performs initialization on the basis of the received clock-shaped pattern, thereby achieving lock.

Figure 2:
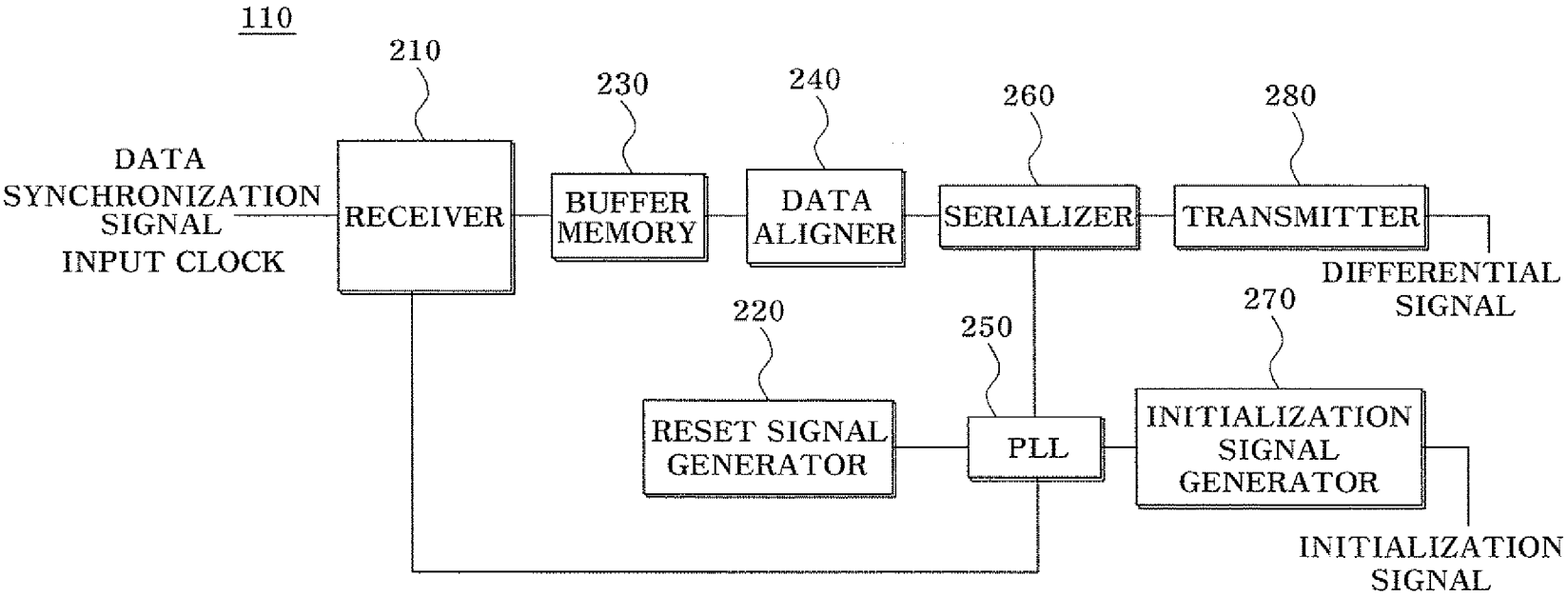
FIG. 2 is a block diagram of the timing controller shown in FIG. 1.

FIG. 2 is a block diagram of the timing controller shown in FIG. 1. Referring to FIG. 2, the timing controller 110 includes a receiver 210, a reset signal generator 220, a buffer memory 230, a data aligner 240, a PLL 250, a serializer 260, an initialization signal generator 270, and a transmitter 280.

The receiver 210 receives low-voltage differential signaling (LVDS) data. Here, the LVDS data includes 8-bit red-green-blue (RGB) data, an 8-bit synchronization signal, and an 8-bit input clock CLK_in.

The reset signal generator 220 generates and transmits a reset signal RS to the PLL 250 when initial power is applied from the outside or a frequency of the input clock CLK_in changes. The reset signal RS enables the PLL 250 to start coarse tuning and fine tuning.

The buffer memory 230 receives the RGB data from the receiver 210, temporarily stores the received RGB data, and then outputs the stored RGB data to the data aligner 240.

The data aligner 240 receives the RGB data from the buffer memory 230, splits the RGB data according to the respective data driver ICs 120, and provides the split RGB data to the serializer 260 so that the transmitter 280 can transmit the data to the respective data driver ICs 120 on a point-to-point basis. The data aligner 240 provides a clock-shaped pattern other than the RGB data to the serializer 260 during an initialization time.

The PLL 250 includes an LC VCO, and divides the frequency of the input clock CLK_in to generate an insertion clock CLK_em. Here, the insertion clock CLK_em corresponds to a first clock CLK_1 that the timing controller 110 of FIG. 1 inserts between data. When the reset signal RS is received from the reset signal generator 220, the PLL 250 performs coarse tuning and fine tuning to be synchronized with a phase of the input clock CLK_in, and generates the insertion clock CLK_em having a frequency corresponding to a multiple of the frequency of the input clock CLK_in.

The serializer 260 receives the RGB data split according to the respective data driver ICs 120 from the data aligner 240 and serializes the RGB data. The serializer 260 receives the insertion clock CLK_em from the PLL 250 and inserts the insertion clock CLK_em in the serialized RGB data, thereby generating transmission data. During the initialization time, the serializer 260 receives the clock-shaped pattern from the data aligner 240, serializes the received clock-shaped pattern, and provides the serialized pattern to the transmitter 280.

The initialization signal generator 270 generates an initialization signal notifying whether it is the initialization time to the respective data driver ICs 120. Here, the initialization signal may be high during the initialization time, and low during a time other than the initialization time. As an example, the initialization time may be a predetermined time after the PLL 250 is locked for the first time. As another example, the initialization time may be a predetermined time after the PLL 250 is unlocked due to an intermediate change in a frequency of a signal input to the PLL 250 and then locked again. As still another example, the initialization time may be the last vertical blank period among blank periods in which the RGB data is not transmitted, and a length of a blank period may be set to be shorter than that required by a system.

The transmitter 280 converts the transmission data into a differential signal, and transmits the differential signal to the data driver ICs 120 through the transmission lines 130, respectively. The transmitter 280 transmits the initialization signal to the data driver ICs 120 through the initialization signal lines 140, respectively.

Figure 3:
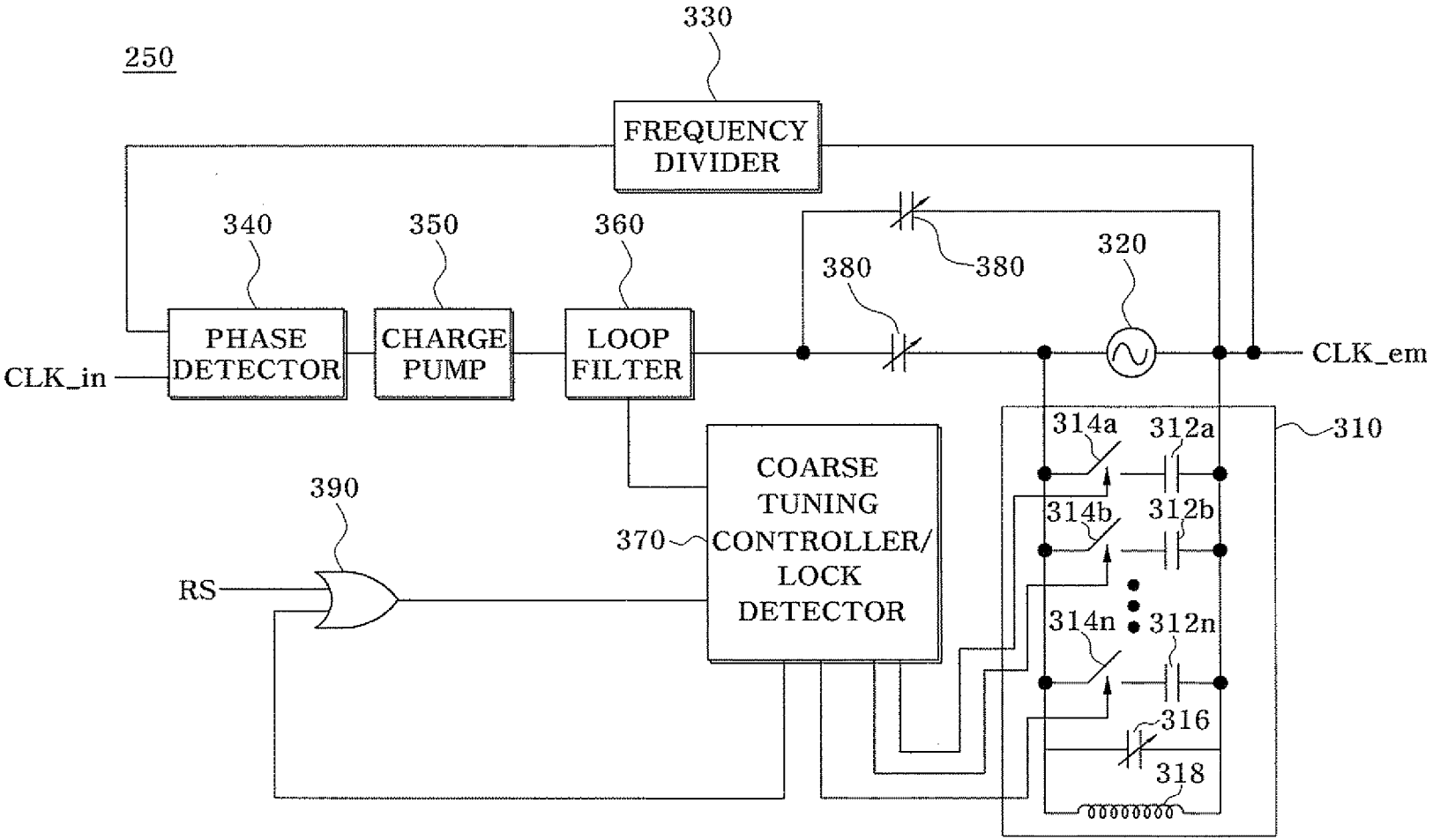
FIG. 3 illustrates a phase-locked loop (PLL) shown in FIG. 2.

FIG. 3 illustrates a PLL shown in FIG. 2. Referring to FIG. 3, the PLL 250 includes an LC resonant circuit 310, an oscillator 320, a frequency divider 330, a phase detector 340, a charge pump 350, a loop filter 360, a coarse tuning controller/lock detector 370, a varactor 380, and a logical disjunction operator 390. Here, the LC resonant circuit 310 and the oscillator 320 may constitute an LC VCO.

The LC resonant circuit 310 is connected in parallel with the oscillator 320. The LC resonant circuit 310 includes a plurality of fixed capacitors 312, a plurality of switches 314, and an inductor 318. At least one of the fixed capacitors 312 is connected in parallel with the oscillator 320 according to operation of the switches 314. The oscillator 320 generates a signal having an oscillation frequency corresponding to a resonant frequency of the LC resonant circuit 310 connected in parallel with the oscillator 320 itself. Here, coarse frequency tuning of the oscillator 320 is performed by switching at least one of the plurality of capacitors 312. The resonant frequency of the LC resonant circuit 310 changes according to a switching operation, and a frequency of the signal output from the oscillator 320 also changes according to the changed resonant frequency. Fine frequency tuning of the oscillator 320 may be performed by adjusting voltage applied to the varactor 380. The varactor 380 has a variable capacitance changing according to the applied voltage.

The insertion clock CLK_em that is the signal output from the oscillator 320 is fed back to the phase detector 340 via the frequency divider 330. The frequency divider 330 divides the frequency of the signal output from the oscillator 320 according to a previously set ratio to generate a divided insertion clock CLK_div, and transmits the divided insertion clock CLK_div to the phase detector 340. The phase detector 340 receives the divided insertion clock CLK_div and the input clock CLK_in, compares a phase of the divided insertion clock CLK_div and that of the input clock CLK_in, and generates a direct current (DC) error signal corresponding to the phase difference. The charge pump 350 receives the error signal and outputs current corresponding to the error signal.

The loop filter 360 receives the current from the charge pump 350 and generates control voltage according to the received current. The frequency of the signal output from the oscillator 320 may be adjusted by the control voltage through a coarse tuning mechanism and fine tuning mechanism. To be specific, when a tuning start signal is received from the logical disjunction operator 390, the coarse tuning controller/lock detector 370 starts operation, and adjusts the switches 314 on the basis of the control voltage received from the loop filter 360, thereby adding or removing at least one of the fixed capacitors 312 to/from the LC resonant circuit 310. Also, voltage applied to the varactor 380 may be adjusted by the control voltage output from the loop filter 360. Through the two tuning mechanisms, the oscillation frequency of the oscillator 320 may be tuned. Here, a tuning range of the oscillation frequency according to the varactor 380 may be little larger than that dependent on one fixed capacitor.

The logical disjunction operator 390 performs a logical disjunction operation on the reset signal RS and an internal unlock signal, thereby generating the tuning start signal that causes the PLL 250 to start coarse frequency tuning. If one of the reset signal RS generated when initial power is applied from the outside or the frequency of the input clock CLK_in changes and the internal unlock signal generated due to an abnormal operation in the PLL 250 is input, the logical disjunction operator 390 may generate the tuning start signal.

When the tuning start signal is received from the logical disjunction operator 390, the coarse tuning controller/lock detector 370 compares a frequency of the input clock CLK_in with a frequency of the divided insertion clock CLK_div, and adjusts a capacitance of the LC resonant circuit 310 according to the comparison result. As an example, the coarse tuning controller/lock detector 370 may compare the frequency of the input clock CLK_in with the frequency of the divided insertion clock CLK_div on the basis of the control voltage input from the loop filter 360. As another example, the coarse tuning controller/lock detector 370 may receive the input clock CLK_in and the divided insertion clock CLK_div and directly compare the frequencies with each other. The coarse tuning controller/lock detector 370 may perform coarse tuning by turning on or off the switches 314 connected to the capacitors 312. For example, when the frequency of the divided insertion clock CLK_div is lower than that of the input clock CLK_in, the coarse tuning controller/lock detector 370 may reduce the capacitance to increase a frequency of the insertion clock CLK_em that is the output of the oscillator 320. The coarse tuning controller/lock detector 370 detects unlock of the PLL 250 and generates the internal unlock signal.

Figure 4:
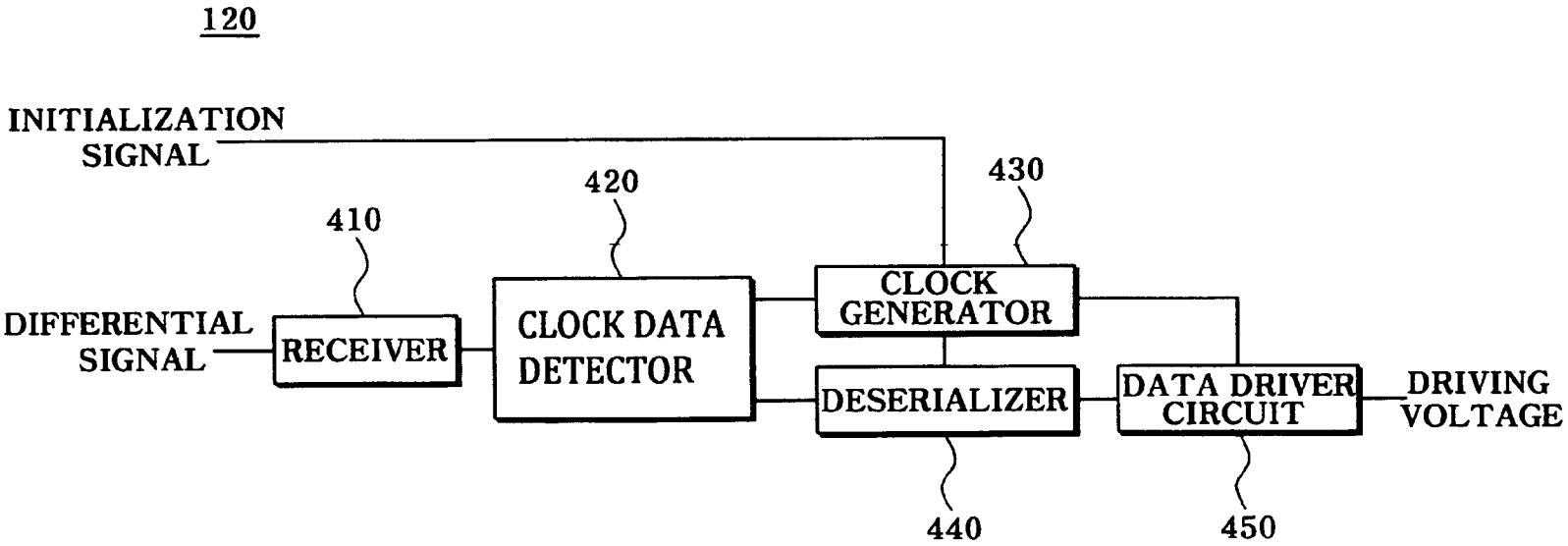
FIG. 4 is a block diagram of a data driver IC shown in FIG. 1.

FIG. 4 is a block diagram of a data driver IC shown in FIG. 1. Referring to FIG. 4, the data driver IC 120 includes a receiver 410, a clock data detector 420, a clock generator 430, a deserializer 440, and a data driver circuit 450.

The receiver 410 receives a differential signal through the transmission line 130, and recovers transmission data from the differential signal. The receiver 410 receives an initialization signal in a high state, and receives a clock-shaped pattern through the transmission line 130.

The clock data detector 420 detects the first clock CLK_1 and serial data from the transmission data. The clock data detector 420 may detect the insertion clock CLK_em included in the transmission data and output the insertion clock CLK_em as the first clock CLK_1.

The clock generator 430 receives the first clock CLK_1 and generates a second clock CLK_2 having a frequency that is a multiple of the frequency of the first clock CLK_1. For example, the clock generator 430 may include a delay-locked loop (DLL) or PLL. When the clock generator 430 is a PLL, the PLL may have the same constitution as the PLL 250 shown in FIG. 3. When the initialization signal is high, the PLL receives the clock-shaped pattern and performs coarse tuning to be locked.

The deserializer 440 converts the serial data into parallel data using the second clock CLK_2.

The data driver circuit 450 samples and latches the parallel data according to the second clock CLK_2, and then performs digital-to-analog conversion on the latched data to generate a driving voltage. The data driver circuit 450 applies the driving voltage to respective signal lines of the liquid crystal panel.

The above-described disclosure may have the following effects. However, it does not mean that a specific embodiment should include all or only the effects, and it should not be understood that the scope of the disclosure is limited thereto.

A timing controller of a display device according to an embodiment of the present disclosure includes an LC VCO having a good phase-noise or jitter characteristic, and thus a high-speed interface can be implemented between the timing controller and data driver ICs.

A timing controller of a display device according to an embodiment of the present disclosure transmits a clock-shaped pattern to each data driver IC for a predetermined time after a PLL is stabilized, so that each data driver IC can effectively recover a clock.

The foregoing is illustrative of the present disclosure and is not to be construed as limiting thereof. Although numerous embodiments of the present disclosure have been described, those skilled in the art will readily appreciate that many modifications are possible in the embodiments without materially departing from the novel teachings and advantages of the present disclosure. Accordingly, all such modifications are intended to be included within the scope of the present disclosure as defined in the claims. Therefore, it is to be understood that the foregoing is illustrative of the present disclosure and is not to be construed as limited to the specific embodiments disclosed, and that modifications to the disclosed embodiments, as well as other embodiments, are intended to be included within the scope of the appended claims. The present disclosure is defined by the following claims, with equivalents of the claims to be included therein.

What is claimed is:

1. A display device, comprising:

a timing controller configured to insert a clock between data, and transmit the data in which the clock has been inserted;

transmission lines configured to transfer the data in which the clock has been inserted; and data driver integrated circuits (IC's) configured to receive the data in which the clock has been inserted, separate the clock from the data, and drive data lines of a liquid crystal panel based on the clock and the data, wherein the timing controller includes:

a phase-locked loop (PLL) including:

a coarse tuning controller configured to: (i) receive a control voltage from a loop filter and a tuning start signal from an OR gate, and (ii) output a control signal for the PLL to perform coarse frequency tuning;

an oscillator and an inductor-capacitor (LC) resonant circuit, the LC resonant circuit is connected in parallel with the oscillator, and the LC resonant circuit includes a plurality of switches controlled by the control signal to perform coarse timing, a plurality of capacitors, and an inductor; and a varactor configured to: (i) change a capacitance of the varactor based on the control voltage from the loop filter, and (ii) perform fine frequency tuning of the oscillator, and a reset signal generator configured to generate a reset signal causing the PLL to start coarse frequency tuning when a frequency of an applied input clock changes, and the timing controller and the data driver IC's are separately located on different ends of the transmission lines.

2. The display device according to claim 1, wherein the plurality of fixed capacitors are connected in parallel with the oscillator through the switch, and when the reset signal is received or the PLL is unlocked, the coarse frequency tuning is performed by controlling the switch to change connection between the plurality of fixed capacitors and the oscillator.

3. The display device according to claim 2, wherein during a predetermined period, the timing controller transmits a clock-shaped pattern to the data driver IC's through the transmission lines and the timing controller transmits an initialization signal to the data driver IC's through additional signal lines.

4. The display device according to claim 3, wherein the predetermined period includes at least one of the following: (1) a predetermined time after the PLL is locked for the first time by application of the power; and (2) a predetermined time after the PLL is unlocked due to a change in a frequency of the input clock input to the PLL and then locked again.

5. The display device according to claim 3, wherein the predetermined period is a last vertical blank period among vertical blank periods in which the data is not transmitted.

6. The display device according to claim 3, wherein the initialization signal is kept high during a period in which the data is not transmitted.

7. The display device according to claim 3, wherein the respective data driver IC's include PLL's and the data driver IC's lock the PLL's on the basis of the clock-shaped pattern received through the transmission lines when the initialization signal is received through the additional signal lines.

8. A display method, comprising:

inserting, by a timing controller, a crock between data;

transmitting the data in which the clock has been inserted through transmission lines;

receiving, by data driver integrated circuits (IC's) separately located at different ends of the transmission lines, the data in which the clock has been inserted;

separating the clock from the data; and driving data lines of a liquid crystal panel based on the clock and the data, wherein when a frequency of an input clock applied to the timing controller changes, a phase locked loop (PLL) performs coarse frequency tuning to lock the clock inserted between the data, the PLL including:

a coarse tuning controller configured to perform: (i) receiving a control voltage from a loop filter and a tuning start signal from an OR gate, and (ii) outputting a control signal for the PLL to perform coarse frequency tuning, and a varactor configured to perform: (i) changing a capacitance of the actor based on the control voltage from the loop filter, and (ii) performing fine frequency tuning of the oscillator.

9. The display method according to claim 8, further comprising:

transmitting, by the timing controller, a clock-shaped pattern to the data driver IC's through the transmission lines; and transmitting, by the timing controller, an initialization signal to the data driver IC's through additional signal lines during a predetermined period.

10. The display method according to claim 9, wherein the predetermined period includes at least one of the following: (1) a predetermined time after the PLL is locked for the first time by application of the power; and (2) a predetermined time after the PLL is unlocked due to a change in a frequency of the input clock input to the PLL and then locked again.

11. The display method according to claim 9, wherein the predetermined period is a last vertical blank period among vertical blank periods in which the data is not transmitted.

12. The display method according to claim 9, wherein the initialization signal is kept high during a period in which the data is not transmitted.

13. The display method according to claim 9, further comprising locking, at the respective data driver IC's, a plurality of PLL's on the basis of the clock-shaped pattern received through the transmission lines when the initialization signal is received through the additional signal lines.

14. The display device according to claim 1, wherein the oscillator generates a signal having an oscillation frequency corresponding to a resonant frequency of the LC resonant circuit.

15. The display method according to claim 8, wherein the oscillator generates a signal having an oscillation frequency corresponding to a resonant frequency of the LC resonant circuit.

* * * * *